US010580347B2

(12) United States Patent
Lee et al.

(10) Patent No.: US 10,580,347 B2
(45) Date of Patent: Mar. 3, 2020

(54) TIMING CONTROLLER, DISPLAY DEVICE INCLUDING TIMING CONTROLLER, AND METHOD OF DRIVING TIMING CONTROLLER

(71) Applicant: Samsung Display Co., Ltd., Yongin-si, Gyeonggi-do (KR)

(72) Inventors: Eun Ho Lee, Yongin-si (KR); Hyun Dae Lee, Yongin-si (KR); Sung Yeol Baek, Yongin-si (KR)

(73) Assignee: Samsung Display Co., Ltd. (KR)

( * ) Notice: Subject to any disclaimer, the term of this patent is extended or adjusted under 35 U.S.C. 154(b) by 471 days.

(21) Appl. No.: 15/073,392

(22) Filed: Mar. 17, 2016

(65) Prior Publication Data

US 2017/0069259 A1 Mar. 9, 2017

(30) Foreign Application Priority Data

Sep. 7, 2015 (KR) ..... 10-2015-0126459

(51) Int. Cl.
*G09G 3/36* (2006.01)
*G09G 3/32* (2016.01)
*G09G 5/10* (2006.01)

(52) U.S. Cl.
CPC ..... *G09G 3/32* (2013.01); *G09G 5/10* (2013.01); *G09G 2310/0213* (2013.01)

(58) Field of Classification Search
CPC ..... G09G 3/32; G09G 3/20; G09G 5/003
USPC ..... 345/99
See application file for complete search history.

(56) References Cited

U.S. PATENT DOCUMENTS

2003/0169247 A1* 9/2003 Kawabe ..... G09G 3/342 345/204
2009/0041371 A1 2/2009 Hasegawa
2012/0079142 A1* 3/2012 Fleegal ..... G09G 5/39 710/30
2013/0194295 A1* 8/2013 Chan ..... G09G 3/3466 345/619
2013/0249962 A1 9/2013 Ozawa et al.
2013/0278619 A1* 10/2013 Belanger ..... G09G 5/363 345/545
2014/0104327 A1* 4/2014 Kim ..... G09G 5/02 345/691

(Continued)

*Primary Examiner* — Jonathan M Blancha
(74) *Attorney, Agent, or Firm* — Innovation Counsel LLP

(57) ABSTRACT

A timing controller includes an interface unit configured to receive first image signals corresponding to a first region of a display panel, the first region including a second region which has image signals changed as compared to the second frame and a surrounding region which surrounds the second region, and a first region coordinate signal containing information about the first region during the first frame period from a host, an image processor configured to generate image-processed second image signals corresponding to the second region of the display panel by image-processing the first image signals of the interface unit, and a buffer unit configured to receive a second region signal corresponding to the second region and the image-processed second image signals of the image processor, generate image-processed entire image signals based on the image-processed second image signals, and transmit the image-processed entire image signals to a data driver.

12 Claims, 5 Drawing Sheets

(56) References Cited

U.S. PATENT DOCUMENTS

| | | | | |
|---|---|---|---|---|
| 2015/0195601 | A1* | 7/2015 | Hahm | H04N 21/4122<br>725/116 |
| 2015/0381987 | A1* | 12/2015 | Imai | H04N 19/507<br>375/240.02 |
| 2016/0027146 | A1* | 1/2016 | Kim | H04N 19/44<br>345/629 |

* cited by examiner

TIMING CONTROLLER, DISPLAY DEVICE INCLUDING TIMING CONTROLLER, AND METHOD OF DRIVING TIMING CONTROLLER

CROSS-REFERENCE TO RELATED APPLICATION

This application claims priority to and the benefit of Korean Patent Application No. 10-2015-0126459, filed on Sep. 7, 2015, in the Korean Intellectual Property Office, the entire contents of which are incorporated herein by reference in their entirety.

BACKGROUND

1. Field

The present inventive concept relates to a timing controller, a display device including the timing controller, and a method of driving the timing controller.

2. Description of the Related Art

After display devices were developed, research to improve a quality of an image displayed by the display device has been recently conducted.

Particularly, research to improve an image quality by processing an image based on grayscale corresponding to image signals has been conducted. For example, image processing for image sharpening may be performed.

SUMMARY

The present inventive concept provides a timing controller, in which an image processor receives both image signals of a region changed as compared to those of a previous frame period, and image signals of a region surrounding the region, in which the image signal is changed, so that the image processor does not use pre-stored image signals of the frame buffer, thereby decreasing a driving frequency and power consumption of the image processor, a display device including the timing controller, and a method of driving the timing controller.

An exemplary embodiment of the present inventive concept provides a timing controller, including: an interface unit configured to receive first image signals corresponding to a first region of a display panel and not to receive image signals except the first image signals during a first frame period which follows a second frame period, the first region including a second region which has image signals changed as compared to the second frame and a surrounding region which surrounds the second region, and a first region coordinate signal containing information about the first region during the first frame period from a host; an image processor configured to generate image-processed second image signals corresponding to the second region of the display panel by image-processing the first image signals of the interface unit; and a buffer unit configured to receive a second region signal corresponding to the second region and the image-processed second image signals of the image processor, generate image-processed entire image signals based on the image-processed second image signals, and transmit the image-processed entire image signals to a data driver.

The buffer unit may include: an encoder configured to generate image and encoding processed second image signals by encoding the image-processed second image signals;

a frame buffer configured to receive and store the image and encoding processed second image signals from the encoder and generate image and encoding processed entire image signals by combining the image and encoding processed second image signals with image signals stored before the first frame period; and a decoder configured to generate the image-processed entire image signals by decoding the image and encoding processed entire image signals from the frame buffer, and transmit the image-processed entire image signals to the data driver.

The timing controller may further include a control signal generating unit, in which the control signal generating unit may receive the first region coordinate signal from the interface unit, generate a first region signal corresponding to the first region and the second region signal based on the first region coordinate signal, and transmit the first region signal and the second region signal to the image processor.

Each of the first region and the second region may have first to fourth sides, the third side and the fourth side may extend in a first direction and the first side and the second side may extend in a second direction crossing the first direction, and the surrounding region may include at least one of a first width between the first side of the first region and the first side of the second region, a second width between the second side of the first region and the second side of the second region, a third width between the third side of the first region and the third side of the second region, and a fourth width between the fourth side of the first region and the fourth side of the second region.

An overhead signal containing information on the first to fourth widths may be generated by the control signal generating unit and is transmitted to the host, and the second region signal may be generated based on the first region coordinate signal and the information on the first to fourth widths.

The timing controller may further include a control signal generating unit, wherein the control signal generating unit receives the first region coordinate signal from the interface unit, generates a first region signal corresponding to the first region and the second region signal based on the first region coordinate signal, transmits the first region signal to the image processor and transmits the second region signal to a buffer unit.

Another exemplary embodiment of the present inventive concept provides a display device including a timing controller, the display device including: a display panel; and a display panel driver configured to drive the display panel, in which the display panel driver may include: a timing controller configured to receive first image signals corresponding to a first region of the display panel and not to receive image signals except the first image signals during a first frame period which follows a second frame period, the first region including a second region which has image signals changed as compared to the second frame and a surrounding region which surrounds the second region, and a first region coordinate signal containing information about the first region during the first frame period from a host, and generate image-processed entire image signals based on the first image signals; and a data driver configured to receive the image-processed entire image signals from the timing controller, and the timing controller may include: an interface unit configured to receive the first image signals and the first region coordinate signal from the host; an image processor configured to generate the image-processed second image signals by image-processing the first image signals of the interface unit; a control signal generating unit configured to receive the first region coordinate signal from the interface unit, generate a first region signal corresponding to the first region and a second region signal corresponding to the second region based on the first region coordinate signal; and a buffer unit configured to receive the second region signal and the image-processed second image signals from the image processor, generate the image-processed entire image signals based on the image-processed second image signals, and transmit the image-processed entire image signals to the data driver.

The buffer unit may include: an encoder configured to generate image and encoding processed second image signals by encoding the image-processed second image signals; a frame buffer configured to receive and store the image and encoding processed second image signals from the encoder and generate image and encoding processed entire image signals by combining the image and encoding processed second image signals with image signals stored before the first frame period; and a decoder configured to generate the image-processed entire image signals by decoding the image and encoding processed entire image signals from the frame buffer, and transmit the image-processed entire image signals to the data driver.

The display panel may include pixels arranged in a first direction and a second direction crossing the first direction, the second region corresponds to pixels disposed at $i^{th}$ to $k^{th}$ rows (i is a natural number, and k is a natural number larger than i) in the first direction and $j^{th}$ to $l^{th}$ (j is a natural number and l is a natural number larger than j) columns in the second direction, the first region corresponds to pixels disposed in $i-w1^{th}$ (w1 is an integer equal to or larger than 0) to $k+w2^{th}$ (w2 is an integer equal to or larger than 0) rows in the first direction, and j−w3th (w3 is an integer equal to or larger than 0) to $l+w4^{th}$ (w4 is an integer equal to or larger than 0) columns in the second direction, and when w1 is equal to or larger than 1, the surrounding region has a first width corresponding to w1 times of a width of each pixel in the first direction, when w2 is equal to or larger than 1, the surrounding region has a second width corresponding to w2 times of the width of each pixel in the first direction, when w3 is equal to or larger than 1, the surrounding region has a third width corresponding to w3 times of a width of each pixel in the second direction, and when w4 is equal to or larger than 1, the surrounding region has a fourth width corresponding to w4 times of the width of each pixel in the second direction.

The display panel driver may generate an overhead signal containing information on the first width to the fourth width, and the overhead signal may include w1 to w4, and is transmitted to the host.

The host may compare image signals during the second frame period that is displayed just before the first frame period with image signals during the first frame period.

The control signal generating unit may transmit the first region signal and the second region signal to the image processor The control signal generating unit may transmit the first region signal to the image process and transmit the second region signal to the buffer unit Yet another exemplary embodiment of the present inventive concept provides a method of driving a timing controller, including: transmitting an overhead signal to a host; receiving first image signals corresponding to a first region of a display panel and not to receive image signals except the first image signals during a first frame period which follows a second frame period, the first region including a second region which has image signals changed as compared to the second frame and a surrounding region which surrounds the second region, and a first region coordinate signal containing information about the first region during a first frame period from the host; generating a first region signal corresponding to the first region and a second region signal corresponding to a second region based on the first region coordinate signals, and generating image-processed second image signals corresponding to the second region by image-processing the first image signals; generating image-processed entire image signals based on the image-processed second image signals; and transmitting the image-processed entire image signals to a data driver.

The generating of the image-processed entire image signals based on the image-processed second image signals may include: generating image and encoding processed second image signals by encoding the image-processed second image signals; generating image and encoding processed entire image signals by combining the image and encoding processed second image signals with image signals stored before the first frame period; and generating the image-processed entire image signals by decoding image and encoding processed entire image signals.

According to the exemplary embodiments of the present inventive concept, there are provided the timing controller, in which the image processor receives both image signals of a region changed as compared to those of a previous frame period, and image signals of a region surrounding the region, in which the image signal is changed, so that the image processor does not use pre-stored image signals of the frame buffer, thereby decreasing a driving frequency and power consumption of the image processor, the display device including the timing controller, and the method of driving the timing controller.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
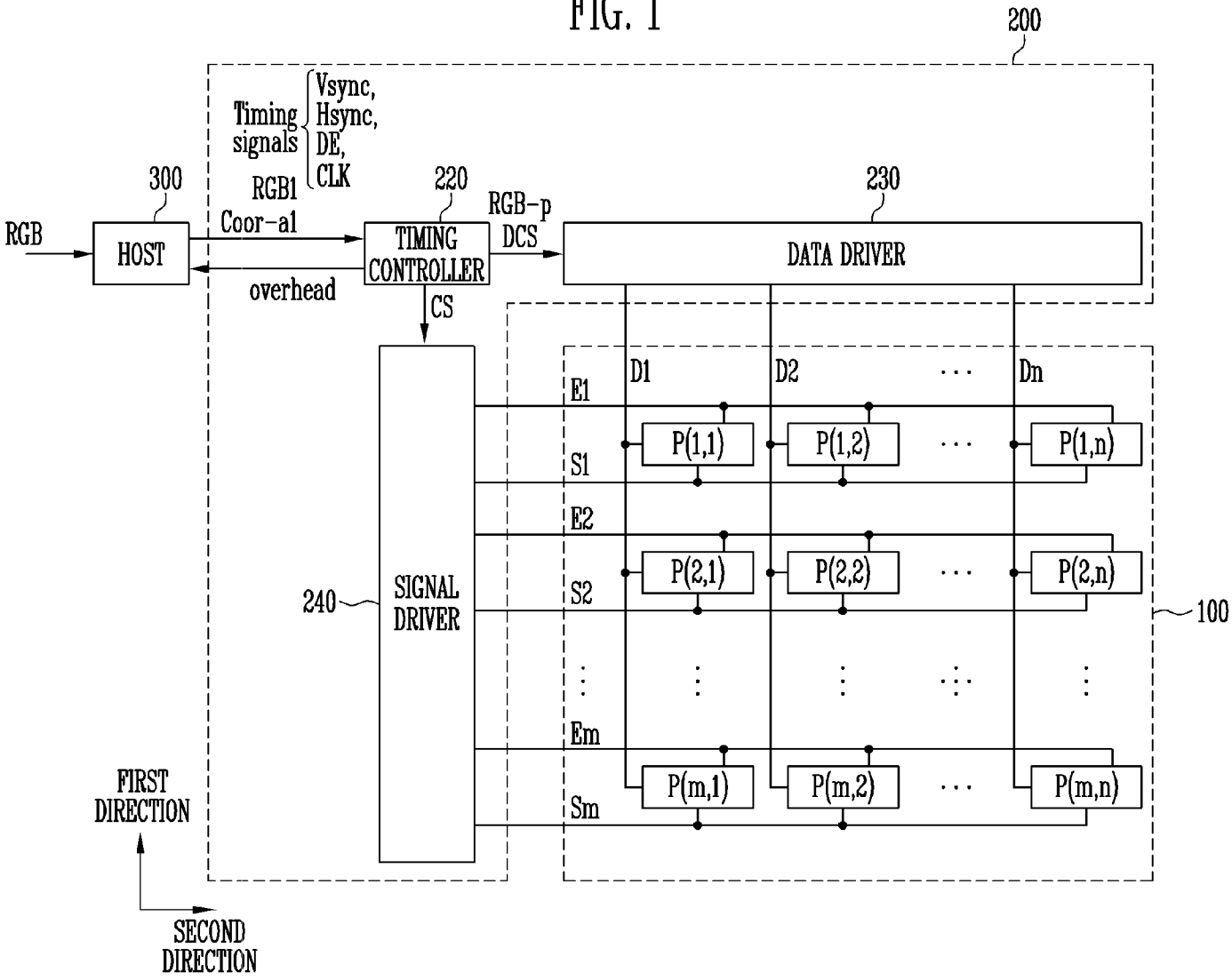
FIG. 1 is a diagram illustrating a display device according to an exemplary embodiment of the present inventive concept.

Hereinafter, exemplary embodiments of the present inventive concept will be described in detail with reference to the accompanying drawings. Like reference numerals principally refer to like elements throughout the specification. In the following description, when the detailed description of the relevant known function or configuration is determined to unnecessarily obscure the important point of the present inventive concept, the detailed description is not provided. Further, a name of a constituent elements used in description below may be selected in consideration of easiness of writing the specification, and thus may be different from a name of a component of an actual product.

Figure 2:
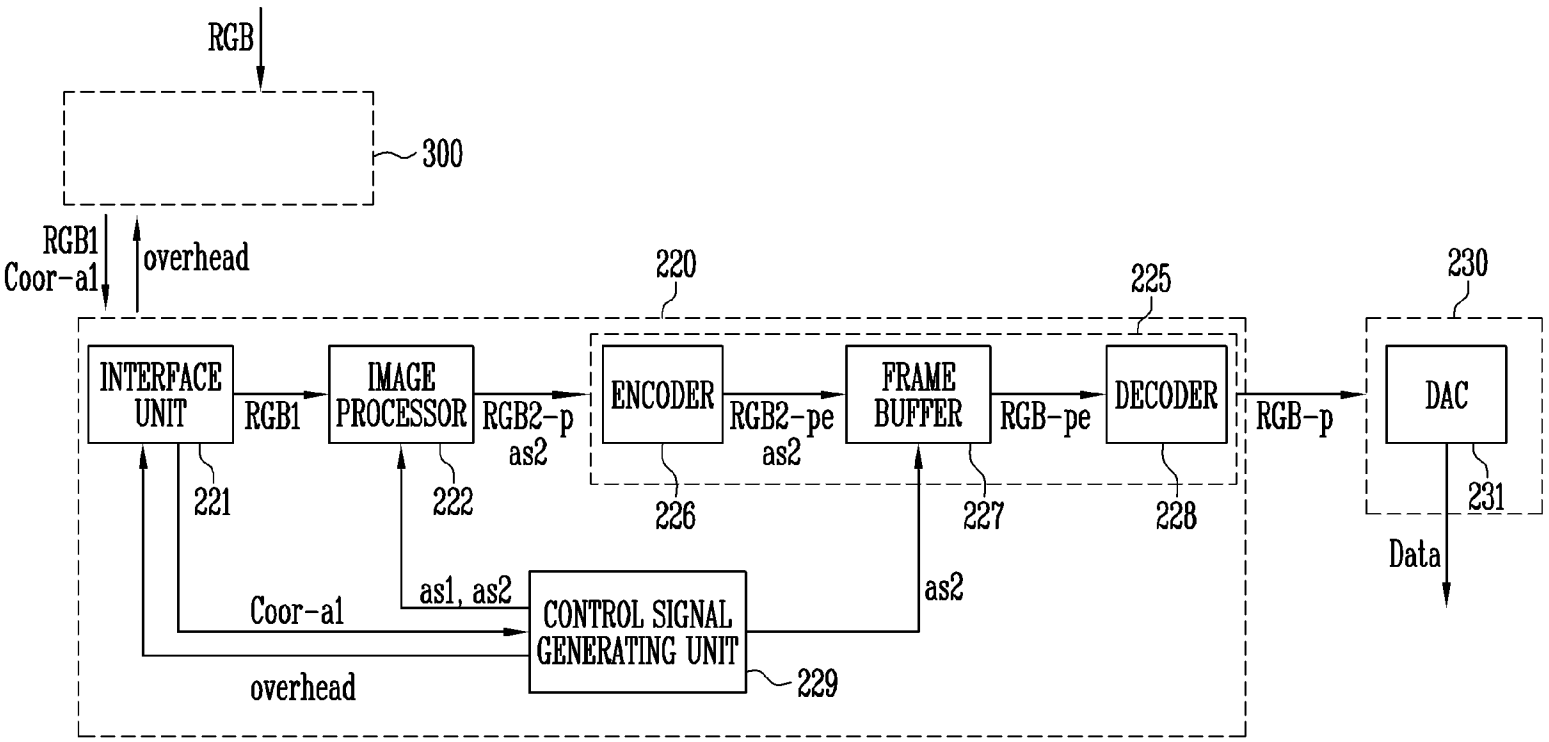
FIG. 2 is a diagram for describing a timing controller and a data driver in the display device of FIG. 1.
Figure 3:
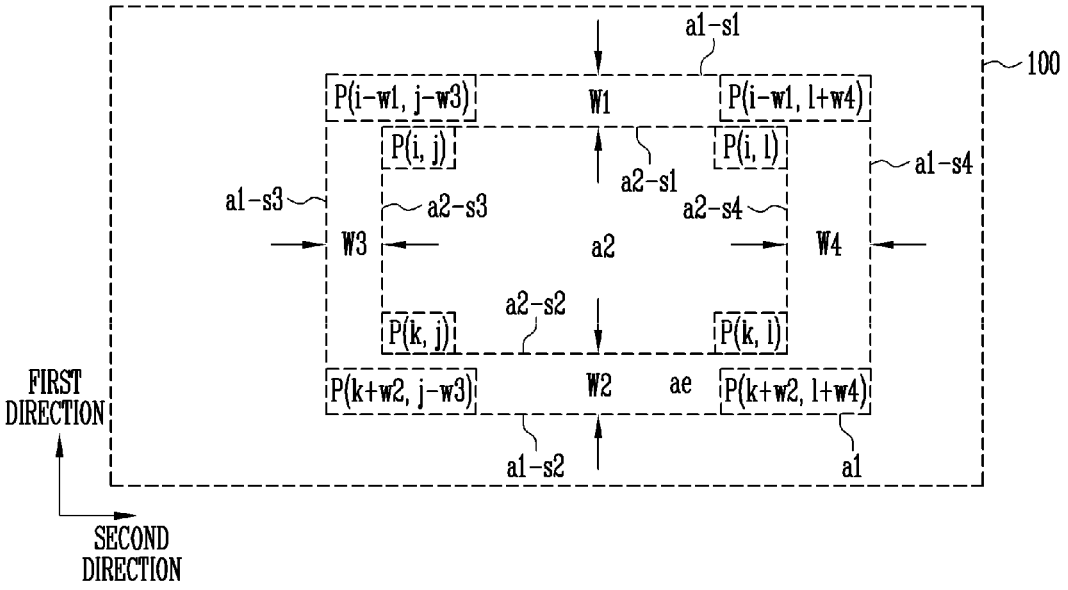
FIG. 3 is a diagram for describing a first region and a second region of a display panel in the display device of FIG. 1.

FIG. 1 is a diagram illustrating a display device according to an exemplary embodiment of the present inventive concept, FIG. 2 is a diagram for describing a timing controller and a data driver in the display device of FIG. 1, and FIG. 3 is a diagram for describing a first region and a second region of a display panel in the display device of FIG. 1.

Referring to FIG. 1, the display device according to an exemplary embodiment of the present inventive concept includes a display panel 100 and a display panel driver 200.

The display panel 100 includes pixels P(1, 1) to P(m, n) (m and n are natural numbers), data lines D1 to Dn (hereinafter, referred to as "D") transmitting data voltages to the pixels P(1, 1) to P(m, n) (hereinafter, referred to as "P"), and scan lines S1 to Sm (hereinafter, referred to as "S") transmitting scan signals to the pixels P. According to an exemplary embodiment, the display panel 100 may further include emission control lines E1 to Em (hereinafter, referred to as "E") transmitting emission control signals to the pixels P. The pixels P may have a matrix configuration arranged in a first direction and a second direction, the data lines D extend in the first direction, and the scan lines S and the emission control lines E may extend in the second direction crossing the first direction. It may be expressed that the pixel P(y, x) (y is a natural number smaller than m, and x is a natural number smaller than n) is disposed at an $y^{th}$ row in the first direction and at an $x^{th}$ column in the second direction. The display panel driver 200 generates data voltages and supplies the generated data voltages to the data lines D, and generates scan signals and supplies the generated scan signals to the scan lines S to drive the display panel 100. According to an exemplary embodiment, the display panel driver 200 may further generate emission control signals and supply the generated emission control signals to the emission control lines E. The display panel driver 200 includes a timing controller 220, a data driver 230, and a signal driver 240. The timing controller 220, the data driver 230, and the signal driver 240 may be implemented as separate electronic devices, and the entire display panel driver 200 may also be implemented as one electronic device (for example, a display driving IC).

The timing controller 220 receives first image signals (RGB1), timing signals (Timing signals), and a first region coordinate signal (coor-a1) from a host 300. The first image signals (RGB1) correspond to a first region (a1) of the display panel 100. The timing signals (Timing signals) include a vertical synchronization signal (Vsync), a horizontal synchronization signal (Hsync), a data enable signal (DE), and a dot clock (CLK). The first region coordinate signal (coor-a1) contains information about the first region (a1). The first region (a1) includes a second region (a2) and a surrounding region (ae) surrounding the second region (a2). For convenience of the description, it may be assumed that each image signal corresponding to the second region (a2) during a first frame period is different from each image signal corresponding to the second region (a2) during a second frame period that is displayed just before the first frame period, and each image signal corresponding to a region, except for the second region (a2), during the first frame period is the same as each image signal corresponding to a region, except for the second region (a2), during the second frame period that is displayed just before the first frame period. That is, the second region (a2) corresponds to a region, in which the corresponding image signal is changed during the first frame period, in the display panel 100. The first region (a1), the second region (a2), and the surrounding region (ae) will be described with reference to FIG. 3. Referring to FIG. 3, the second region (a2) corresponds to the pixels disposed in $i^{th}$ row (i is a natural number smaller than m) to $k^{th}$ row (k is a natural number larger than i and smaller than m) in the first direction, and $j^{th}$ column (j is a natural number smaller than n) to $l^{th}$ column (l is a natural number larger than j and smaller than n) in the second direction. The second region (a2) has a first side (a2-s1) to a fourth side (a2-s4). The first side (a2-s1) and the second side (a2-s2) extend in the second direction, and the third side (a2-s3) and the fourth side (a2-s4) extend in the first direction. Further, the first region (a1) corresponds to the pixels disposed in $i-w1^{th}$ row (w1 is an integer equal to or larger than 0) to $k+w2^{th}$ row (w2 is an integer equal to or larger than 0) in the first direction, and $j-w3^{th}$ column (w3 is an integer equal to or larger than 0) to $l+w4^{th}$ column (w4 is an integer equal to or larger than 0) in the second direction. The first region (a1) includes the second region (a2) and the surrounding region (ae) which do not overlap each other, and has a first side (a1-s1) to a fourth side (a1-s4). The first side (a1-s1) and the second side (a1-s2) extend in the second direction, and the third side (a1-s3) and the fourth side (a1-s4) extend in the first direction. When w1 is equal to or larger than 1, the surrounding region (ae) has a first width W1 between the first side (a1-s1) of the first region and the first side (a2-s1) of the second region, and the first width W1 corresponds to w1 times of a length of the pixel P(m, n) in the first direction. When w2 is equal to or larger than 1, the surrounding region (ae) has a second width W2 between the second side (a1-s2) of the first region and the second side (a2-s2) of the second region, and the second width W2 corresponds to w2 times of a length of the pixel P(m, n) in the first direction. When w3 is equal to or larger than 1, the surrounding region (ae) has a third width W3 between the third side (a1-s3) of the first region and the third side (a2-s3) of the second region, and the third width W3 corresponds to w3 times of a length of the pixel P(m, n) in the second direction. When w4 is equal to or larger than 1, the surrounding region (ae) has a first width W4 between the fourth side (a1-s4) of the first region and the fourth side (a2-s4) of the second region, and the fourth width W4 corresponds to w4 times of a length of the pixel P(m, n) in the second direction. Here, at least one of w1, w2, w3, and w4 is equal to or larger than 1. Accordingly, the surrounding region (ae) includes at least a part of an exterior region of the second region (a2). When the first region (a1) corresponds to the pixels disposed in the $i-w1^{th}$ row (w1 is an integer equal to or larger than 0) to $k+w2^{th}$ row (w2 is an integer equal to or larger than 0) in the first direction, and the $j-w3^{th}$ column (w3 is an integer equal to or larger than 0) to $l+w4^{th}$ column (w4 is an integer equal to or larger than 0) in the second direction, the coordinate signal (coor-a1) may include (i−w1, j−w3, k+w2, l+w4). Otherwise, the coordinate signal (coor-a1) may also include (i−w1, j−w3, k+w2−i+w1, l+w4−j+w3).

The timing controller 220 generates a image-processed entire image signals RGB-p which are image-processed based on the first image signals RGB1 and the first region coordinate signal (coor-a1), and generates a timing control signal CS and a data timing control signal DCS based on the timing signals (Timing signals). The timing control signal CS may include a scan timing control signal, and may further include an emission control timing control signal according to an exemplary embodiment. The timing controller 220 supplies the image-processed entire image signals RGB-p and the data timing control signal DCS to the data driver 230, and supplies the timing control signal CS to the signal driver 240. Further, the timing controller 220 may generate an overhead signal (overhead) and transmit the generated overhead signal (overhead) to the host 300.

The data driver 230 latches the image-processed entire image signals RGB-p input from the timing controller 220 in response to the data timing control signal DCS. The data driver 230 includes a plurality of source drive ICs, and the source drive ICs may be electrically connected to the data lines D of the display panel 100 by a Chip On Glass (COG) process or a Tape Automated Bonding (TAB) process.

The signal driver 240 supplies the scan signals to the scan lines S in response to the timing control signal CS. According to an exemplary embodiment, the signal driver 240 may further supply the emission control signals to the emission control lines E.

Referring to FIG. 2, the timing controller 220 includes an interface unit 221, an image processor 222, a control signal generating unit 229, and a buffer unit 225. The buffer unit 225 includes an encoder 226, a frame buffer 227, and a decoder 228.

The interface unit 221 receives the first image signals RGB1 corresponding to the first region (a1) of the display panel 100, the first region coordinate signal (coor-a1) containing the information about the first region (a1) during the first frame period from the host 300, transmits the first image signals RGB1 to the image processor 222, and transmits the first region coordinate signal (coor-a1) to the control signal generating unit 229. Further, the interface unit 221 receives the overhead signal (overhead) from the control signal generating unit 229, and transmits the overhead signal (overhead) to the host 300.

The image processor 222 receives the first image signals RGB1 from the interface unit 221, and receives a first region signal (as1) corresponding to the first region (a1) and a second region signal (as2) corresponding to the second region (a2) from the control signal generating unit 229. The image processor 222 generates image-processed second image signals RGB2-*p* by image-processing the first image signals RGB1. The image-processed second image signals RGB2-*p* correspond to the second region (a2). The image processor 222 transmits the image-processed second image signals RGB2-*p* and the second region signals (as2) to the encoder 226 of the buffer unit 225. The second region signal (as2) generated by the control signal generating unit 229 is transmitted to the encoder 226 through the image processor 222, which may cause a delay.

The encoder 226 receives the image-processed second image signals RGB2-*p* and the second region signals (as2) from the image processor 222, and generates image and encoding processed second image signals RGB2-*pe* by encoding the image-processed second image signals RGB2-*p*. The encoder 226 may transmits the image and encoding processed second image signals RGB2-*pe* and the second region signals (as2) to the frame buffer 227 of the buffer unit 225.

The frame buffer 227 receives the image and encoding processed second image signals RGB2-*pe* and the second region signals (as2) from the encoder 226. Data, which has been displayed before the first frame period and encoded, is stored in the frame buffer 227, so that the frame buffer 227 may generate image and encoding processed entire image signals RGB-pe by combining the image signals, which had been stored before the first frame period, and the image and encoding processed second image signals RGB2-*pe*. Particularly, in a part corresponding to the second region (a2), the image signal corresponding to the second frame period that is just before the first frame period is different from the image signal corresponding to the first frame period, so that the image and encoding processed second image signals RGB2-*pe* are selected. The part corresponding to the second region (a2) among the image signals, which had been stored before the first frame period, may be changed into the image and encoding processed second image signals RGB2-*pe* and stored in the frame buffer 227. By contrast, in a part not-corresponding to the second region (a2), the image corresponding to the second frame period that is just before the first frame period is the same as the image signal corresponding to the first frame period, so that the image signals that are previously stored in the frame buffer 227 are called and used. When the part corresponding to the second region (a2) is combined with the part not-corresponding to the second region (a2), the image and encoding processed entire image signals RGB-pe may be generated.

The decoder 228 generates the image-processed entire image signals RGB-p by decoding the image and encoding processed entire image signals RGB-pe from the frame buffer 227.

The control signal generating unit 229 generates an overhead signal (overhead) and transmits the generated overhead signal (overhead) to the interface unit 221, receives the first region coordinate signal (coor-a1) from the interface unit 221, and generates the first region signal (as1) and the second region signal (as2) and transmits the generated first region signal (as1) and second region signal (as2) to the image processor 222. The overhead signal (overhead) includes at least one of w1, w3, w2, and w4 or W1, W3, W2, and W4. The control signal generating unit 229 may calculate the second region (a2) based on the first region coordinate signal (coor-a1) and the overhead signal (overhead). For example, when the first region coordinate signal (coor-a1) includes i−w1, j−w3, k+w2, and l+w4, and the overhead signal (overhead) includes w1, w3, w2, and w4, it can be seen that the second region (a2) corresponds to the pixels disposed at the $i^{th}$ to $k^{th}$ rows in the first direction and the $j^{th}$ to $l^{th}$ columns in the second direction. In a specific exemplary embodiment, w1 and w2 may have a value of 0, and w3 and w4 may have a value equal to or larger than 1. In this case, the image processor 222 may perform the image processing (for example, emphasizing a boundary line) only in the second direction. In another exemplary embodiment, w1 and w2 may have a same value, w3 and w4 may have a same value, w1 and w3 may have different values, and all of w1, w2, w3, and w4 may have a value equal to or larger than 1. In this case, the image processor 222 may perform the image processing in the first direction and the second direction, but an algorithm for performing the image processing in the first direction may be different from an algorithm for performing the image processing in the second direction. The control signal generating unit 229 may determine the first region (a1) and the second region (a2), so that the control signal generating unit 229 generates the first region signal (as1) corresponding to the first region (a2) and the second region signal (as2) corresponding to the second region (a2) and transmits the generated first region signal (as1) and second region signal (as2) to the image processor 222. It is illustrated that the second image signal (as2) is generated by the control signal generating unit 229 and is transmitted to the buffer unit 225 via the image processor 222, which is, however, a simple exemplary embodiment. The second image signal (as2) generated by the control signal generating unit 229 may also be directly transmitted to the frame buffer 227.

The data driver 230 includes a digital analog converter 231. The digital analog converter 231 receives the image-processed entire image signals RGB-p from the decoder 228 of the timing controller 220, and converts the image-processed entire image signals RGB-p into analog signals to generate data voltages Data. The data voltages may be supplied to the data lines D.

The host 300 receives the overhead signal (overhead) from the interface unit 221, and receives the image signals corresponding to the first frame period from an external device (not illustrated). In this case, the host 300 compares the image signals for the second frame period that is displayed just before the first frame period with the image signals for the first frame period. Based on the aforementioned assumption, the host 300 determines that a region, in which the image signal is changed as compared to that for the second frame period, as the second region (a2), and generates the first region coordinate signal (coor-a1) based on the second region (a2) and the overhead signal (overhead). The second region (a2) corresponds to the pixels disposed in the $i^{th}$ (i is a natural number smaller than m) to $k^{th}$ (k is a natural number larger than i and smaller than m) rows in the first direction, and the $j^{th}$ (j is a natural number smaller than n) to $l^{th}$ (l is a natural number larger than j and smaller than n) columns in the second direction, and the overhead signal (overhead) of the interface unit 221 includes w1, w3, w2, and w4, so that the first region coordinate signal (coor-a1) may include (i−w1, j−w3, k+w2, l+w4). The host 300 transmits the first region coordinate signal (coor-a1) to the interface unit 221, and transmits only the first image signals RGB1 corresponding to the first region (a1) among the entire image signals RGB to the interface unit 221.

In order to decrease power consumption according to the transception of the data, the image signals, which are changed as compared to those of the previous frame period, have been transmitted to the interface unit. In the meantime, in order to process a boundary line, the region, in which the image signal is changed, and the image signals in the surrounding region are required. Accordingly, in order to process a boundary line, an additional image signal needs to be received from the frame buffer, in which the image signals for the previous frame period are stored. However, in this case, the frame buffer needs to provide the image signals for each frame, so that a driving frequency needs to have a predetermined value or larger (for example, 60 Hz), and a driving frequency of the image processor needs to be the same as a driving frequency of the data frame, so that the driving frequency of the image processor is increased. Accordingly, there is a problem in that power consumption of the image processor is increased.

However, for the timing controller 220 of the present inventive concept, the interface unit 221 only receives the surrounding image signals (the image signals corresponding to the surrounding region (ae)) of the region, in which the image signal is changed, as well as the image signals (the image signals corresponding to the second region (a2)) changed as compared to those of the previous frame period. Accordingly, the image processor 222 does not need to receive the image signals of the previous frame period from the frame buffer 227, so that the driving frequency of the image processor 222 may be decreased. Accordingly, power consumption of the image processor 222 may also be decreased.

Figure 4:
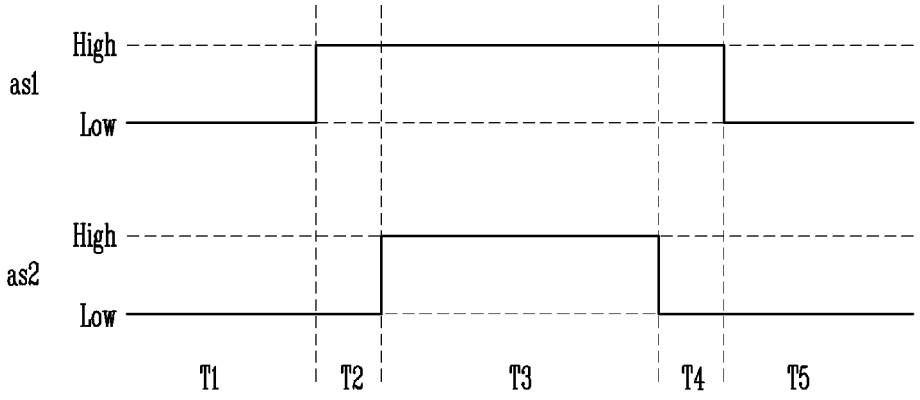
FIG. 4 is a diagram for describing a first region signal and a second region signal generated by the timing controller in the display device of FIG. 1.

FIG. 4 is a diagram for describing a first region signal and a second region signal generated by the timing controller in the display device of FIG. 1. A part of the first region signal (as1) included in the first region (a1) has a high level, and a part of the first region signal (as1) not-included in the first region (a1) has a low level. Similarly, a part of the second region signal (as2) included in the second region (a2) has a high level, and a part of the second region signal (as2) not-included in the second region (a2) has a low level. Here, the second region signal (as2) illustrated in FIG. 4 is the second region signal (as2) transmitted from the control signal generating unit 229 to the image processor 222. The second region signal (as2) transmitted from the image processor 222 to the encoder 226 have the same signal shape, but may have delay. The first region (a1) includes the second region (a2), so that the part having the high level in the first region signal (as1) includes the part having the high level in the second region signal (as2). In FIG. 4, the part having the high level in the first region signal (as1) is second to fourth periods T2 to T4, and the part having the high level in the second region signal (as2) is a third period T3, which is, therefore, included in the second to fourth periods T2 to T4.

Figure 5:
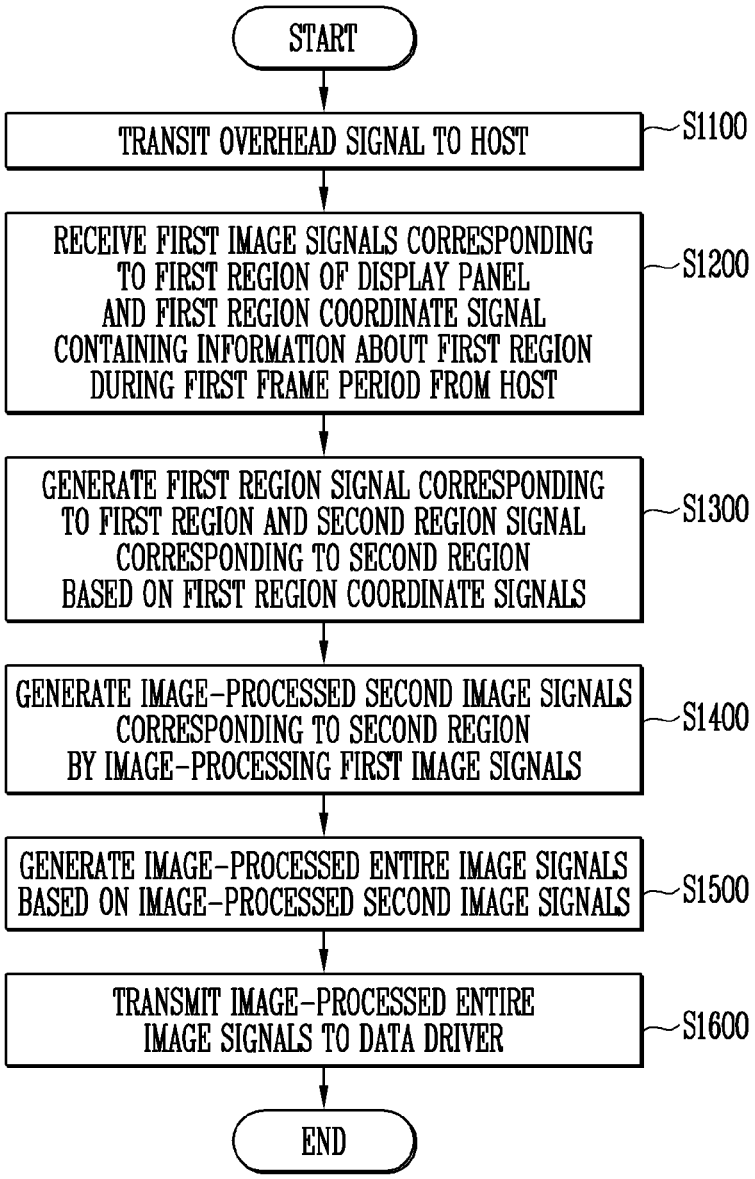
FIG. 5 is a diagram for describing a method of driving the timing controller according to an exemplary embodiment of the present inventive concept.

FIG. 5 is a diagram for describing a method of driving the timing controller according to an exemplary embodiment of the present inventive concept. Hereinafter, the method of driving the timing controller according to an exemplary embodiment of the present inventive concept will be described with reference to FIGS. 1 to 5.

In operation S1100, an overhead signal (overhead) is generated by the control signal generating unit 229, and is transmitted to the host 300 via the interface unit 221.

After operation S1100, the host 300 compares image signals during a second frame period that is displayed just before a first frame period with image signals during the first frame period. The host 300 determines that a region, in which the image signal is changed as compared to that of the second frame period, is a second region (a2), and generates a first region coordinate signal (coor-a1) including (i−w1, j−w3, k+w2, l+w4) based on i, j, k, and l of the second region (a2) and the overhead signal (overhead). Further, the host 300 transmits only first image signals RGB1 corresponding to the first region (a1) among the entire image signals RGB to the interface unit 221.

In operation S1200, the interface unit 221 receives the first image signals RGB1 and the first region coordinate signal (coor-a1) from the host 300. The first image signals RGB1 correspond to the first region (a1) and the first region coordinate signal (coor-a1) contains information about the first region (a1), which have been described above.

In operation S1300, the control signal generating unit 229 receives the first region coordinate signal (coor-a1) from the interface unit 221, and generates a first region signal (as1) and a second region signal (as2) based on the first region coordinate signal (coor-a1). The generation of the first region signal (as1) and a second region signal (as2) by the control signal generating unit 229 has been described above, so that a detailed description thereof is omitted.

In operation S1400, the image processor 222 receives the first image signals RGB1 from the interface unit 221, receives the first region signal (as1) and the second region signal (as2) from the control signal generating unit 229, and generates image-processed second image signals RGB2-*p* by performing image processing. The generation of the image-processed second image signals RGB2-*p* has been described above. In operation S1400, the image processor 222 further transmits the second region signal (as2) to the buffer unit 225.

In operation S1500, the buffer unit 225 generates image-processed entire image signals RGB-p based on the image-processed second image signals RGB2-*p*. Detailed contents of operation S1500 will be described with reference to FIG. 6.

In operation S1600, the timing controller 220 transmits the image-processed entire image signals RGB-p to the data driver 230.

Figure 6:
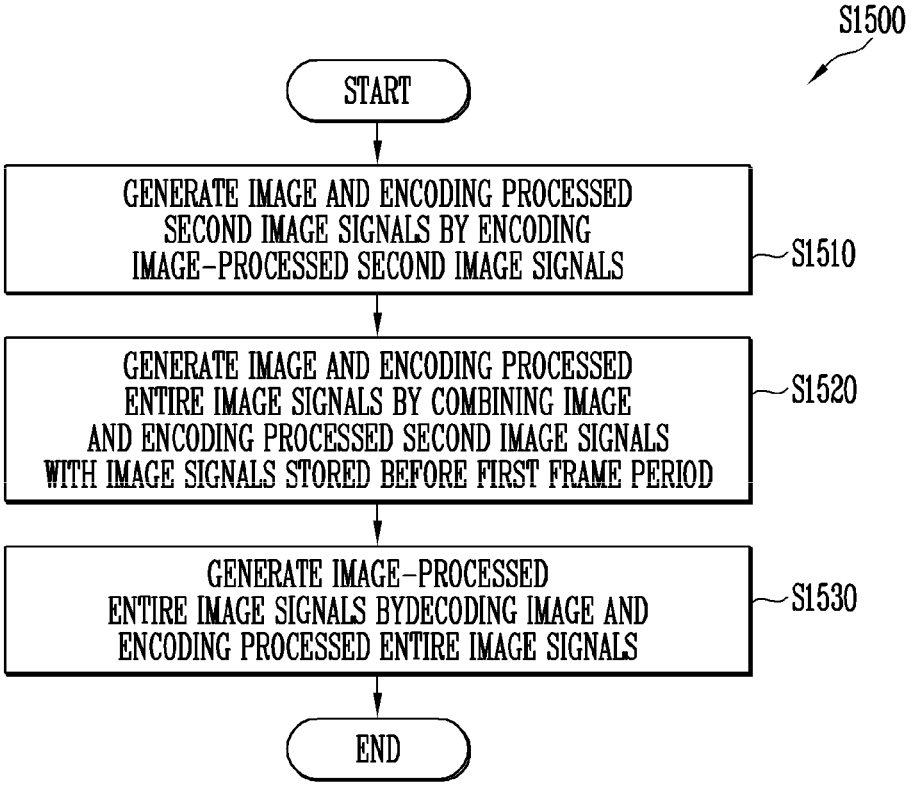
FIG. 6 is a diagram for describing an operation of generating entire image signals based on image-processed second image signals of FIG. 5.

FIG. 6 is a diagram for describing an operation of generating the entire image signals based on the image-processed second image signals of FIG. 5.

In operation S1510, the encoder 226 generates image and encoding processed second image signals RGB2-*pe* by encoding the image-processed second image signals RGB2-*p*. The encoder 226 also receives the second region signal as2 from the image processor 222.

In operation S1520, the frame buffer 227 generates image and encoding processed entire image signals RGB-pe by receiving the image and encoding processed second image signals RGB2-*pe* and the second region signal as2 from the encoder 226, and combining the image and encoding processed second image signals RGB2-*pe* with previously stored image signals. For example, it may be assumed that the image signals, which had been displayed in the second frame that is just before the first frame, have been stored in the frame buffer 227 in an encoded state. Then, when the frame buffer 227 receives the image and encoding processed second image signals RGB2-*pe* and the second region signal (as2), a part corresponding to the second region (a2) among the encoded image signals is replaced with the image and encoding processed second image signals RGB2-*pe*, which immediately become the image and encoding processed entire image signals RGB-pe.

In operation S1530, the decoder 228 generates the image-processed entire image signals RGB-p by decoding the image and encoding processed entire image signals RGB-pe.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present inventive concept as set forth in the following claims.

What is claimed is:

1. A timing controller, comprising:

an interface unit configured to receive first image signals corresponding to a first region of a display panel during a first frame period which follows a second frame period and not to receive image signals except the first image signals during the first frame period, the first image signals including image signals less than image signals for an entire frame of the display panel and including a second region which has image signals changed as compared to the second frame and a surrounding region which surrounds the second region, and a first region coordinate signal containing information about the first region during the first frame period from a host;

an image processor configured to generate image-processed second image signals corresponding to the second region of the display panel by image-processing the first image signals of the interface unit; and a buffer unit configured to receive a second region signal corresponding to the second region and the image-processed second image signals of the image processor, generate image-processed entire image signals based on the image-processed second image signals, and transmit the image-processed entire image signals to a data driver, wherein the buffer unit includes:

an encoder configured to generate image and encoding processed second image signals by encoding the image-processed second image signals;

a frame buffer configured to receive and store the image and encoding processed second image signals from the encoder and generate image and encoding processed entire image signals by combining the image and encoding processed second image signals with image signals stored before the first frame period; and a decoder configured to generate the image-processed entire image signals by decoding the image and encoding processed entire image signals from the frame buffer, and transmit the image-processed entire image signals to the data driver.

2. The timing controller of claim 1, further comprising:

a control signal generating unit, wherein the control signal generating unit receives the first region coordinate signal from the interface unit, generates a first region signal corresponding to the first region and the second region signal based on the first region coordinate signal, and transmits the first region signal and the second region signal to the image processor.

3. The timing controller of claim 2, wherein each of the first region and the second region has first to fourth sides, the third side and the fourth side extend in a first direction and the first side and the second side extend in a second direction crossing the first direction, and the surrounding region includes at least one of a first width between the first side of the first region and the first side of the second region, a second width between the second side of the first region and the second side of the second region, a third width between the third side of the first region and the third side of the second region, and a fourth width between the fourth side of the first region and the fourth side of the second region.

4. The timing controller of claim 3, wherein an overhead signal containing information on the first to fourth widths is generated by the control signal generating unit and is transmitted to the host, and the second region signal is generated based on the first region coordinate signal and the information on the first to fourth widths.

5. The timing controller of claim 1, further comprising:

a control signal generating unit, wherein the control signal generating unit receives the first region coordinate signal from the interface unit, generates a first region signal corresponding to the first region and the second region signal based on the first region coordinate signal, transmits the first region signal to the image processor and transmits the second region signal to a buffer unit.

6. A display device, comprising:

a display panel; and a display panel driver configured to drive the display panel, wherein the display panel driver includes:

a timing controller configured to receive first image signals corresponding to a first region of the display panel during a first frame period which follows a second frame period and not to receive image signals except the first image signals during the first frame period, the first image signals including image signals less than image signals for an entire frame of the display panel and including a second region which has image signals changed as compared to the second frame and a surrounding region which surrounds the second region, and a first region coordinate signal containing information about the first region during the first frame period from a host, and generate image-processed entire image signals based on the first image signals; and a data driver configured to receive the image-processed entire image signals from the timing controller, and the timing controller includes:

an interface unit configured to receive the first image signals and the first region coordinate signal from the host;

an image processor configured to generate the image-processed second image signals by image-processing the first image signals of the interface unit;

a control signal generating unit configured to receive the first region coordinate signal from the interface unit, generate a first region signal corresponding to the first region and a second region signal corresponding to the second region based on the first region coordinate signal; and a buffer unit configured to receive the second region signal and the image-processed second image signals from the image processor, generate the image-processed entire image signals based on the image-processed second image signals, and transmit the image-processed entire image signals to the data driver, wherein the buffer unit includes:

an encoder configured to generate image and encoding processed second image signals by encoding the image-processed second image signals;

a frame buffer configured to receive and store the image and encoding processed second image signals from the encoder and generate image and encoding processed entire image signals by combining the image and encoding processed second image signals with image signals stored before the first frame period; and a decoder configured to generate the image-processed entire image signals by decoding the image and encoding processed entire image signals from the frame buffer, and transmit the image-processed entire image signals to the data driver.

7. The display device of claim 6, wherein the display panel includes pixels arranged in a first direction and a second direction crossing the first direction, the second region corresponds to pixels disposed at ith to kth rows (i is a natural number, and k is a natural number larger than i) in the first direction and jth to lth (j is a natural number and l is a natural number larger than j) columns in the second direction, the first region corresponds to pixels disposed in i−w1 th (w1 is an integer equal to or larger than 0) to k+w2th (w2 is an integer equal to or larger than 0) rows in the first direction, and j−w3th (w3 is an integer equal to or larger than 0) to l+w4th (w4 is an integer equal to or larger than 0) columns in the second direction, and when w1 is equal to or larger than 1, the surrounding region has a first width corresponding to w1 times of a width of each pixel in the first direction, when w2 is equal to or larger than 1, the surrounding region has a second width corresponding to w2 times of the width of each pixel in the first direction, when w3 is equal to or larger than 1, the surrounding region has a third width corresponding to w3 times of a width of each pixel in the second direction, and when w4 is equal to or larger than 1, the surrounding region has a fourth width corresponding to w4 times of the width of each pixel in the second direction.

8. The display device of claim 7, wherein the display panel driver generates an overhead signal containing information on the first width to the fourth width, and the overhead signal includes w1 to w4, and is transmitted to the host.

9. The display device of claim 8, wherein the host compares image signals during the second frame period that is displayed just before the first frame period with image signals during the first frame period.

10. The display device of claim 6, wherein the control signal generating unit transmits the first region signal and the second region signal to the image processor.

11. The display device of claim 6, wherein the control signal generating unit transmits the first region signal to the image process and transmits the second region signal to the buffer unit.

12. A method of driving a timing controller, comprising:

transmitting an overhead signal to a host;

receiving first image signals corresponding to a first region of a display panel during a first frame period which follows a second frame period and not to receive image signals except the first image signals during the first frame period, the first image signals including image signals less than image signals for an entire frame of the display panel and including a second region which has image signals changed as compared to the second frame and a surrounding region which surrounds the second region, and a first region coordinate signal containing information about the first region during a first frame period from the host;

generating a first region signal corresponding to the first region and a second region signal corresponding to a second region based on the first region coordinate signals, generating image-processed second image signals corresponding to the second region by image-processing the first image signals;

generating image-processed entire image signals based on the image-processed second image signals; and transmitting the image-processed entire image signals to a data driver, wherein the generating of the image-processed entire image signals based on the image-processed second image signals includes:

generating image and encoding processed second image signals by encoding the image-processed second image signals;

generating image and encoding processed entire image signals by combining the image and encoding processed second image signals with image signals stored before the first frame period; and generating the image-processed entire image signals by decoding image and encoding processed entire image signals.

* * * * *